US009970203B1

(12) United States Patent
Abidov et al.

(10) Patent No.: US 9,970,203 B1
(45) Date of Patent: May 15, 2018

(54) ADJUSTING DEVICE

(71) Applicants: Bekzod Abidov, Toronto (CA); Israel Avnilov, Toronto (CA)

(72) Inventors: Bekzod Abidov, Toronto (CA); Israel Avnilov, Toronto (CA)

( * ) Notice: Subject to any disclaimer, the term of this patent is extended or adjusted under 35 U.S.C. 154(b) by 0 days. days.

(21) Appl. No.: 15/813,708

(22) Filed: Nov. 15, 2017

(51) Int. Cl.

| | |
|---|---|
| ***E04F 21/18*** | (2006.01) |
| ***E04F 21/20*** | (2006.01) |
| ***E04F 21/22*** | (2006.01) |
| *E04F 13/08* | (2006.01) |

(52) U.S. Cl.
CPC ..... *E04F 21/1877* (2013.01); *E04F 21/20* (2013.01); *E04F 21/22* (2013.01); *E04F 13/0892* (2013.01)

(58) Field of Classification Search
CPC ... E04F 21/1877; E04F 21/0092; E04F 21/20; E04F 21/22; E04F 13/0892; E04F 15/02005
See application file for complete search history.

(56) References Cited

U.S. PATENT DOCUMENTS

| | | | | |
|---|---|---|---|---|
| 5,603,195 | A * | 2/1997 | Cosentino | E04F 13/0892 52/127.3 |
| 7,992,354 | B2 * | 8/2011 | Doda, Jr. | E04F 13/0892 52/127.7 |
| 8,671,628 | B2 * | 3/2014 | Sighinolfi | E04F 15/02022 33/527 |
| 8,800,246 | B2 * | 8/2014 | Gorton | E04F 21/0092 52/747.11 |
| 8,887,475 | B2 * | 11/2014 | Ghelfi | E04F 21/0092 52/749.11 |
| 9,045,911 | B2 * | 6/2015 | Hoffman | E04F 21/0092 |
| 9,260,872 | B2 * | 2/2016 | Bunch | E04F 21/0092 |
| 9,322,185 | B1 * | 4/2016 | Russo | E04F 21/0092 |
| 9,447,590 | B2 * | 9/2016 | Sighinolfi | E04F 21/18 |
| 9,487,959 | B2 * | 11/2016 | Bunch | E04F 21/1844 |
| 9,534,403 | B2 * | 1/2017 | Biec | E04F 21/0092 |
| 9,562,365 | B2 * | 2/2017 | Bucsa | E04F 21/0092 |

* cited by examiner

*Primary Examiner* — Andrew J Triggs
(74) *Attorney, Agent, or Firm* — Nasser Ashgriz; UIPatent Inc.

(57) ABSTRACT

The present invention is an adjusting device used for adjusting and leveling a plurality of tiles on a floor or a wall during an installation, the adjusting device comprises of a clip which is placed underneath a laying surface of at least two adjacent tiles and comprises of a top portion in vertical plane, and it has an opening which receives a first wedge and has three sharp edges around the opening to grab the first wedge, a bottom plate in horizontal plane comprises of a flat base having at least two support protrusions at each side to support a tile, and a first wedge has two triangle faces and one quadrilateral face having teeth to be engaged with the opening in the clip, so the first wedge presses the tiles towards the bottom plate of the clip in such a way to level the tiles.

8 Claims, 14 Drawing Sheets

ADJUSTING DEVICE

FIELD OF THE INVENTION

The present invention relates in general to tiling industry and in specific to a device for leveling and adjustment of tiles during installment.

BACKGROUND OF THE INVENTION

A construction tile is used for covering floors, walls and many other applications. A construction tile is made of a manufactured piece of hard-wearing material such as ceramic, stone, metal or glass, and it can come in different shapes and designs.

Proper installment of tiles is challenging because of the need to leveling and alignment of each tile with its neighboring ones, in order to provide a smooth and uninterrupted look. Tile installers spend a significant amount of time to level and adjust the tiles. And still in many cases the final result is not acceptable and the job has to be done again.

Tile leveling and adjustment is time consuming and cumbersome because of several factors. For this purpose different tile leveling devices are invented to help this process. One commonly used tile leveling device is a wedge having a set of teeth on it top surface, insertion of the wedge inside the clip helps to level the adjacent tiles. The prior art device has some cumbersomes which decrease the speed of operation and the quality of final product.

One important one is the alignment of the corners of two or three neighboring tiles, in particular if the tiles are not all square. For example, in installing triangular tiles, at least three tiles have to be aligned at their meeting point.

Another factor that affects the quality of the installment is the contraction and expansion of the mortar when it dries. The contraction and expansion of the mortar can cause misalignment of the tiles. The current tile leveling devices do not consider the mortar contraction and expansion after drying, and therefore, cannot prevent such effects.

Another issue with the currently used tile adjustment devices is that they require the tile setters to use a rubber hammer to level and adjust the tiles on the floor or the wall. This may cause damage to the surface of the tile, or a premature breaking of the tile, or even cause some micro-cracks inside the tiles, which may not be visible at the time of installation, but may grow overtime.

The presently available tile leveling and adjusting devices are designed for smaller size tiles. They fail when used on Large Format Tile (LFT). The current leveling devices may allow one tile to slide over the other. A device that can be used for all different sizes is needed. Another problem with current devices is that they result in an empty spots between the base and the tile, which may cause damage to the tile.

Once the tile is leveled, the clip of the leveling device has to be removed. Another issue with the currently used leveling devices is that they do not have any provisions to facilitate easy removal of the clip. The clip is broken by forcing it, which may cause damage to the installed tiles.

Many of the tile leveling devices incorporates a set of teeth on the top surface of the wedge. The clip is set in between two tiles, and the wedge is inserted into the top opening of the clip and forced in to make sure the two neighboring tiles are leveled. The force needed to push the wedge inward and level the tiles may be so large that it may break the clip. To prevent the breakage of the clip, the prior art discloses a special type of plyer that holds the clip while inserting the wedge. The presently disclosed invention does not require a plyer.

Therefore, there is a need for a new device to level tiles of any size, shape and design that is easy to use and eliminates the issued mentioned above.

SUMMARY OF THE INVENTION

The present invention is new alignment device for the installation of tiles. It can level at least two adjacent tiles on a floor or a wall. It comprises of three parts (a clip, a wedge and a wedge extension). The clip from end is placed underneath a laying surface of at least two neighboring tiles, and from the other end extends outward. The wedge is presses into clip, forcing the tiles towards the base of the clip to level the tiles. The present invention overcomes all the mentioned problems in the prior arts and can significantly reduce the installation time and cost.

The clip in the present invention comprises of a top portion and a bottom portion, wherein the top portion has an opening which can receive the wedge. The top portion has three sharp edges (top edge and side edges) around the opening to grab onto the teeth's of the wedge. The top portion further has a ribbon A thicker section) at a distal end to strengthen the top portion. The top portion also has a V-shaped groove, to facilitate the breaking of the clip.

The clip comprises of a bottom plate, which lays on the floor, and a vertically extended top, which extends vertically and upwardly from the bottom plate. The bottom plate comprises of at least two support protrusions at each side to support one tile. The bottom plate also has two channel-shaped opening to facilitate the over-flow of the mortar (cement or adhesive) between the bottom plate and the tile. Two channel-shaped opening around the protrusions allow the bottom plate and the tile be filled by the mortar, making a strong binding. Therefore, the present invention does not result in any void regions between the clip and the tile, preventing formation of weak spots and potential breaking point.

The present invention further comprises of an extension wedge (rubber wedge) which goes inside the first wedge to extend the wedge height. The extension wedge is made of a rubber material which can extend the wedge height for a thin tile. The extension wedge protects the surface of the sensitive tiles (marble, glass or mirror tiles) against damage and scratch.

The wedge of the present invention has a hollow wedge-body, which is defined by two planes facing at a small acute angle. The wedge-body comprises of five faces. Two of the triangular faces have teeth to be engaged with the opening of the clip. In addition, the top quadrilateral face of the wedge has teeth to be engaged with the opening of the clip. In the hollow wedge-body, there is a supporting wedge-shaped face to be engaged with the top portion of the extension wedge.

The first objective of the present invention is to provide a device for leveling complex tiles. The wedge of the present invention can be inserted into the clip of the present invention to level the tiles.

The second objective of the present invention is to provide a device to increase the lifetime of the installed tiles by preventing formation of voids and empty spots between the base and the tiles, during the installation.

The third objective of the present invention is to provide a device to decrease the installation time and cost by elimination of a need to use a plyer for fastening the wedge into the clip.

The forth objective of the present invention is to provide a device to protect the surface of the sensitive tiles and also increase the wedge height for thin tiles.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The device disclosed herein, in accordance with one or more various embodiments, is described in detail with reference to the following figures. The drawings are provided for purposes of illustration only and merely depict typical or example embodiments of the disclosed device. These drawings are provided to facilitate the reader's understanding of the disclosed device and shall not be considered limiting of the breadth, scope, or applicability thereof. It should be noted that for clarity and ease of illustration these drawings are not necessarily made to scale.

Figures 1A, 1B:
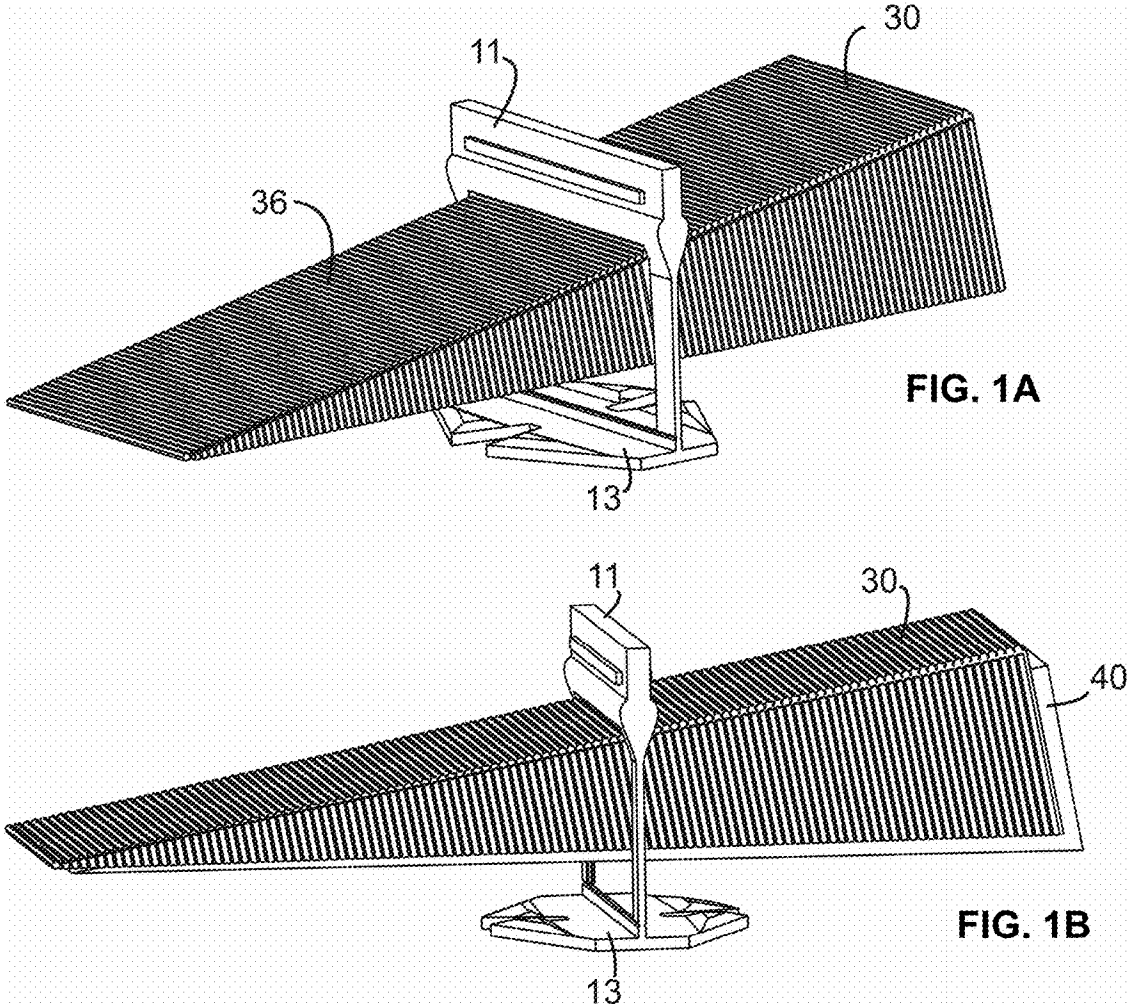
FIG. 1A shows a perspective view of the first embodiment of the present invention.
FIG. 1B shows a perspective view of the second embodiment of the present invention.

FIG. 1A shows the first embodiment of the present invention, which is used for adjusting and leveling of at least two adjacent tiles on a floor or a wall or other spaces. As shown in FIG. 1A, the present invention comprises of two parts: a clip 11 and a wedge 30. Clip 11 in the present invention is placed underneath a laying surface of at least two adjacent tiles and the wedge 30 is pressed into the clip opening. By forcing the wedge into the clip, the tiles are forces towards the bottom plate 13 of the clip 11, thereby they become leveled with each other.

Figure 2:
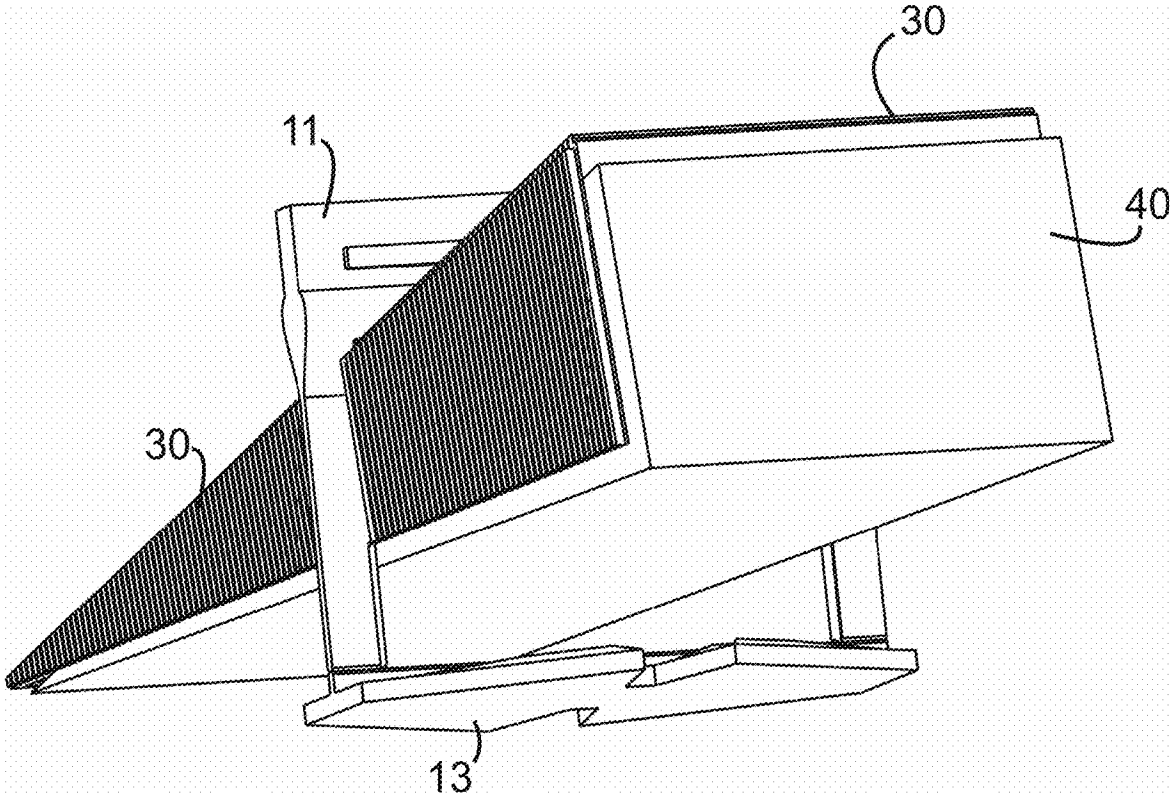
FIG. 2 shows a perspective view of the second embodiment of the present invention.
Figures 3A, 3B:
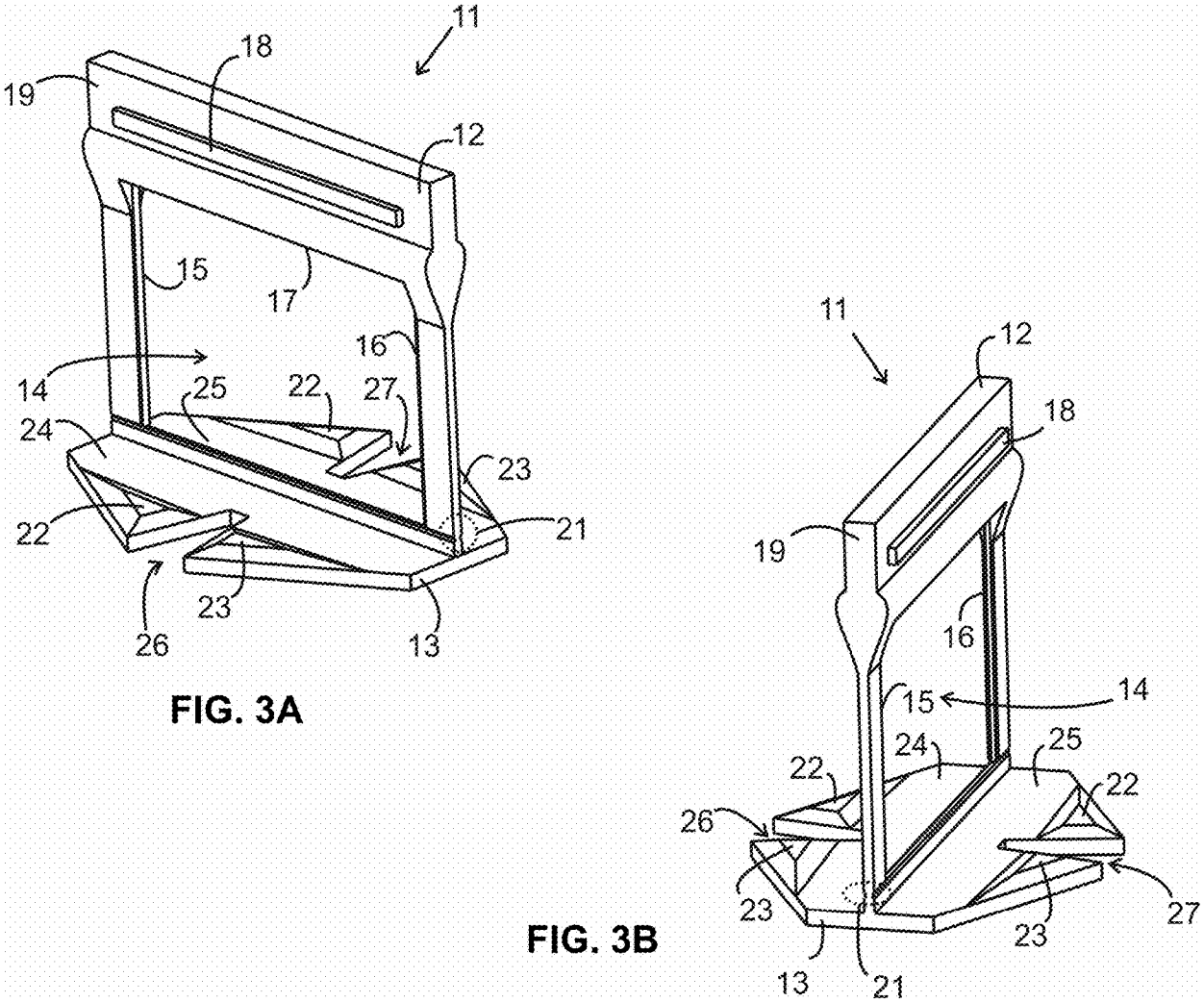
FIG. 3A shows a perspective view of the clip of the present invention.
FIG. 3B shows a perspective view of the clip of the present invention.
Figure 4B:
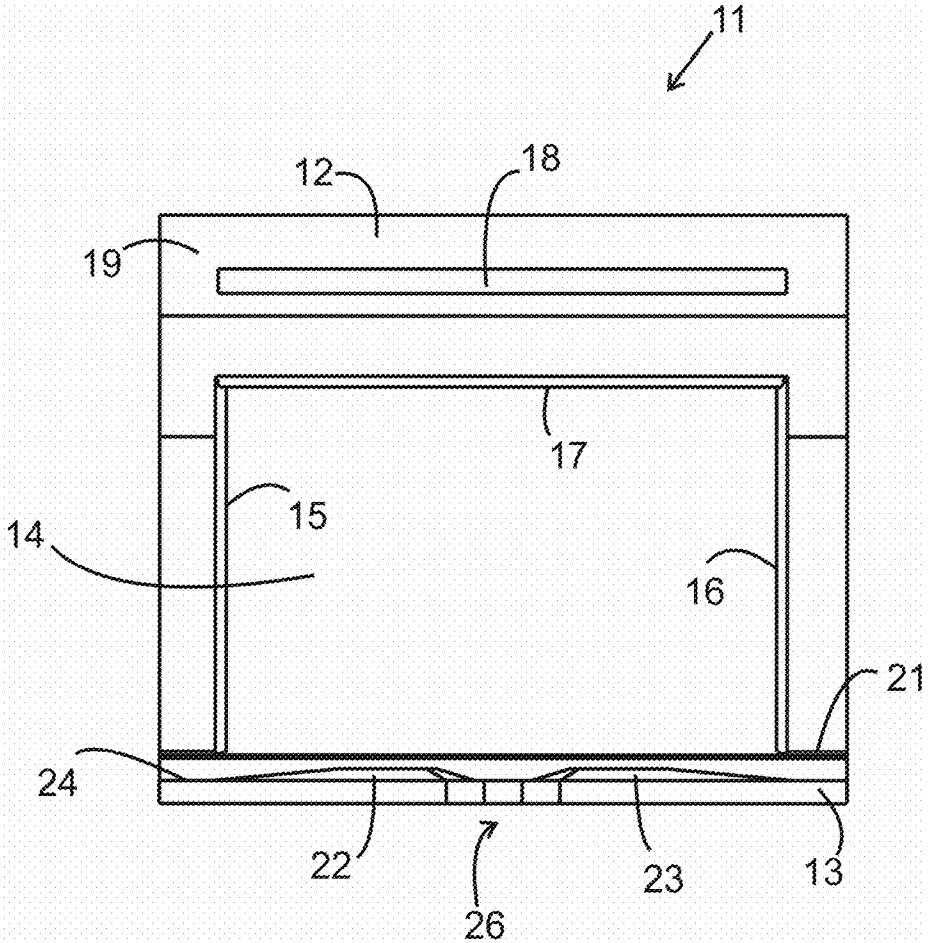
FIG. 4B shows a front view of the clip of the present invention.
Figure 4A:
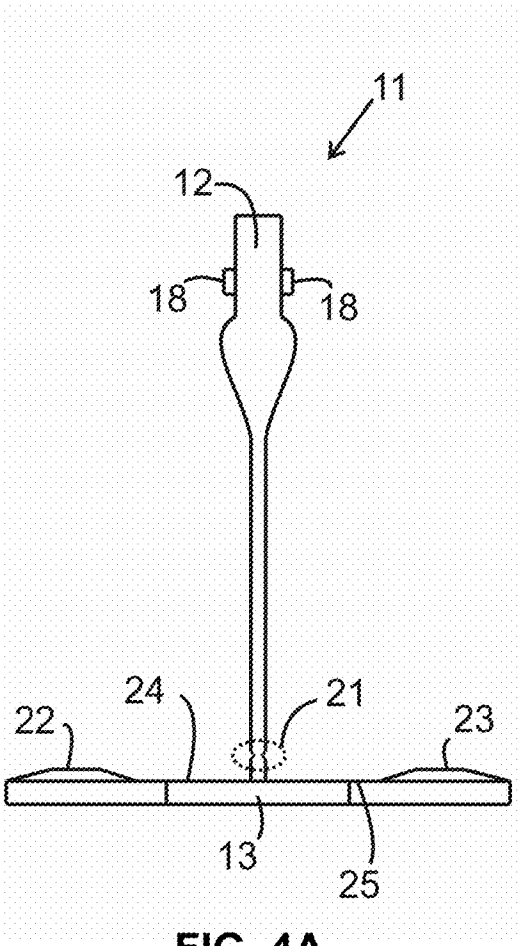
FIG. 4A shows a side view of the clip of the present invention.

FIGS. 1B and 2 show the second embodiment of the present invention, which comprises of three parts: a clip 11, a wedge 30, and an extension wedge 40. Clip 11 is placed underneath a laying surface of at least two adjacent tiles and the wedge 30 along with the extension wedge 40 are pressed into the clip, forcing the tiles towards the bottom plate 13 of the clip 11, thereby, becoming leveled.

FIGS. 3A, 3B, 4A and 4B show clip 11 of the present invention. Clip 11 comprises of a top portion 12 and a bottom plate 13, wherein the top portion 12 has an opening 14, which can receive the wedge 30. The top portion 12 also has three sharp edges 15-17 (top edge 17 and side edges 15, 16) around the opening 14 to grab the first wedge 30. The top portion 12 further has a ribbon 18 at a distal end 19 to strengthen the top portion 12. The ribbon 18 at both sides helps clip 11 to resist high pressures during the installation of larger format tiles or stones.

The top portion 12 also has a V-shaped groove 21, which acts as a breaking point to facilitate separation process. The groove makes it easy to remove the top portion 12 from the bottom plate 13. The V-shaped groove 21 acts as a breaking point that makes strong connection between bottom plate 13 and top portion 12 of the clip 11. It also prevents the expansion and breaking out during tile installation.

Again as shown in FIGS. 3A, 3B, 4A and 4B, the bottom plate 13 of the clip 11 is in horizontal plane and the top portion 12 of the clip 11 is in vertical plane relative to the bottom plate 13. The bottom plate 13 comprises of at least two support protrusions 22-23 at each side 24-25. The protrusions are provided to have a better support for a tile. Two support protrusions 22-23 also prevent tiles to slide from each other in opposite direction by increased pressure and help to tighten both tiles during installation. The bottom plate 13 also has two channel-shaped opening 26, 27 to facilitate the over-flow of the mortar (cement or adhesive) between the bottom plate 13 and the tile. The two channel-shaped opening 26, 27 around the protrusions 23, 24, provide a space between the bottom plate 13 and the tile, which can be filled by the mortar to provide a strong binding between the bottom plate 13 and the tile. In the present invention, there is no empty spot between the clip 11 and the tile, and therefore, minimizing the potential for tile breakage with time. Voids and empty spots are the source of crack formation, and stresses applied on the tiles eventually force the cracks to propagate.

Figure 5A:
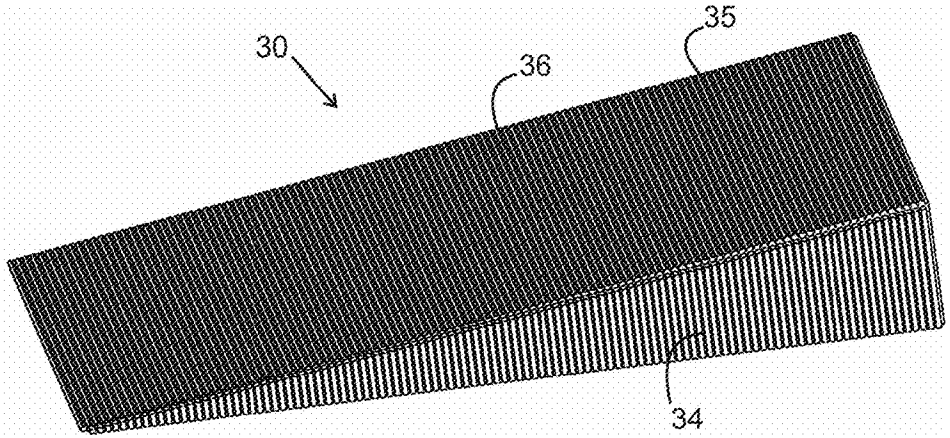
FIG. 5A shows a perspective view of the first wedge of the present invention from the top.
Figure 5B:
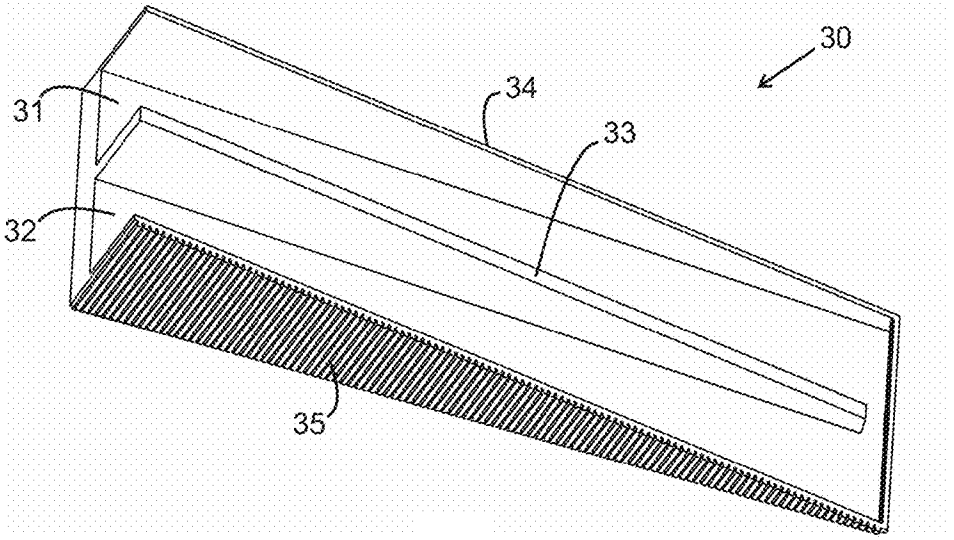
FIG. 5B shows a perspective view of the first wedge of the present invention from the bottom.

As shown in FIGS. 5A and 5B, the back side of the wedge 30 has a wedge-plane 33 facing at a small acute angle, which divides the back side of the wedge into two open zones 31, 32. The wedge 30 comprises of five faces: two triangular side faces 34, 35; one quadrilateral top face 36; wedge-plane 33.

The two triangular side faces 34, 35, have teeth throughout their surface. This allows the wedge to engage with the side walls of the clip 11. The quadrilateral top face 36 also has teeth to be engaged with the opening 14 of the clip 11. The wedge-plane 33 can be engaged with a slot 41 in the top part 42 of the extension wedge 40 in the second embodiment of the present invention as shown in FIG. 7A.

Figure 6:
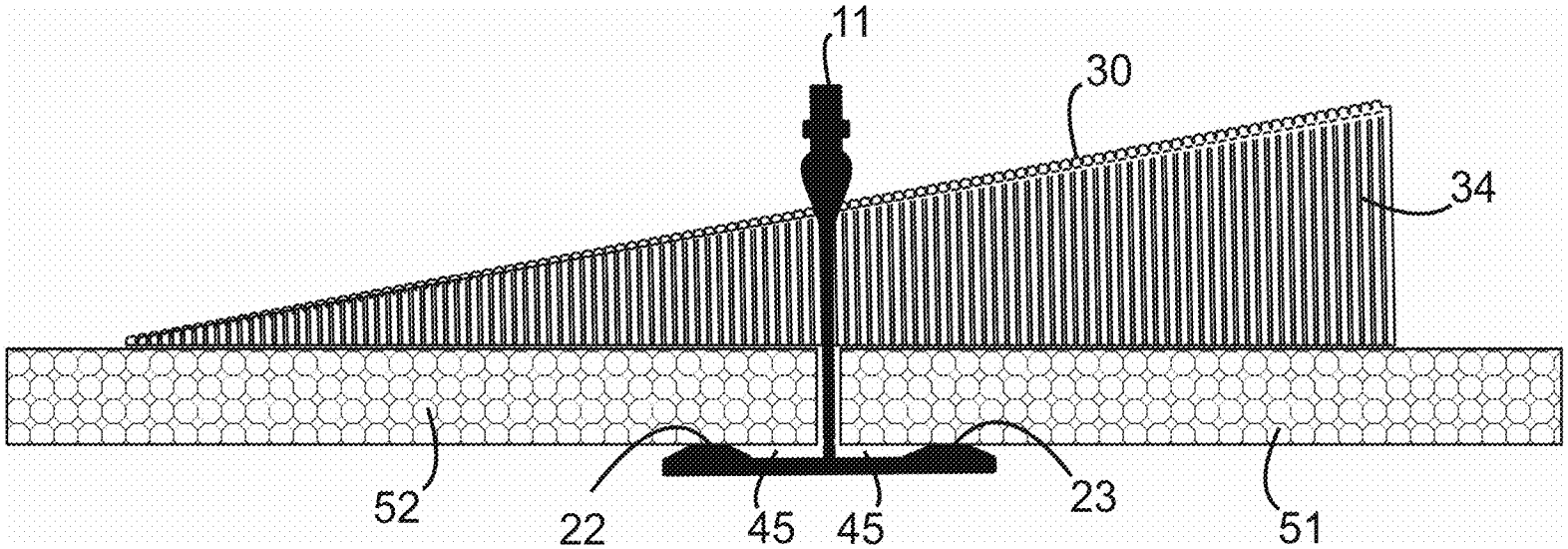
FIG. 6 shows a side view of the first embodiment of the present invention for adjusting and leveling of two tiles.

FIG. 6 shows the first embodiment of the present invention for leveling and adjusting two adjacent tiles 51, 52. Again as shown in FIG. 6, the space 45 between bottom plate 13 and the tile can be filled by the mortar with two channel-shaped opening around the protrusions 23, 24 to make a strong binding between the bottom plate 13 to the tiles 51, 52. By having the channel-shaped opening and the protrusions 23, 24, there is no empty spot between the clip 11 and the tile so it prevents the breaking of the tile in time.

Figures 7A, 7B:
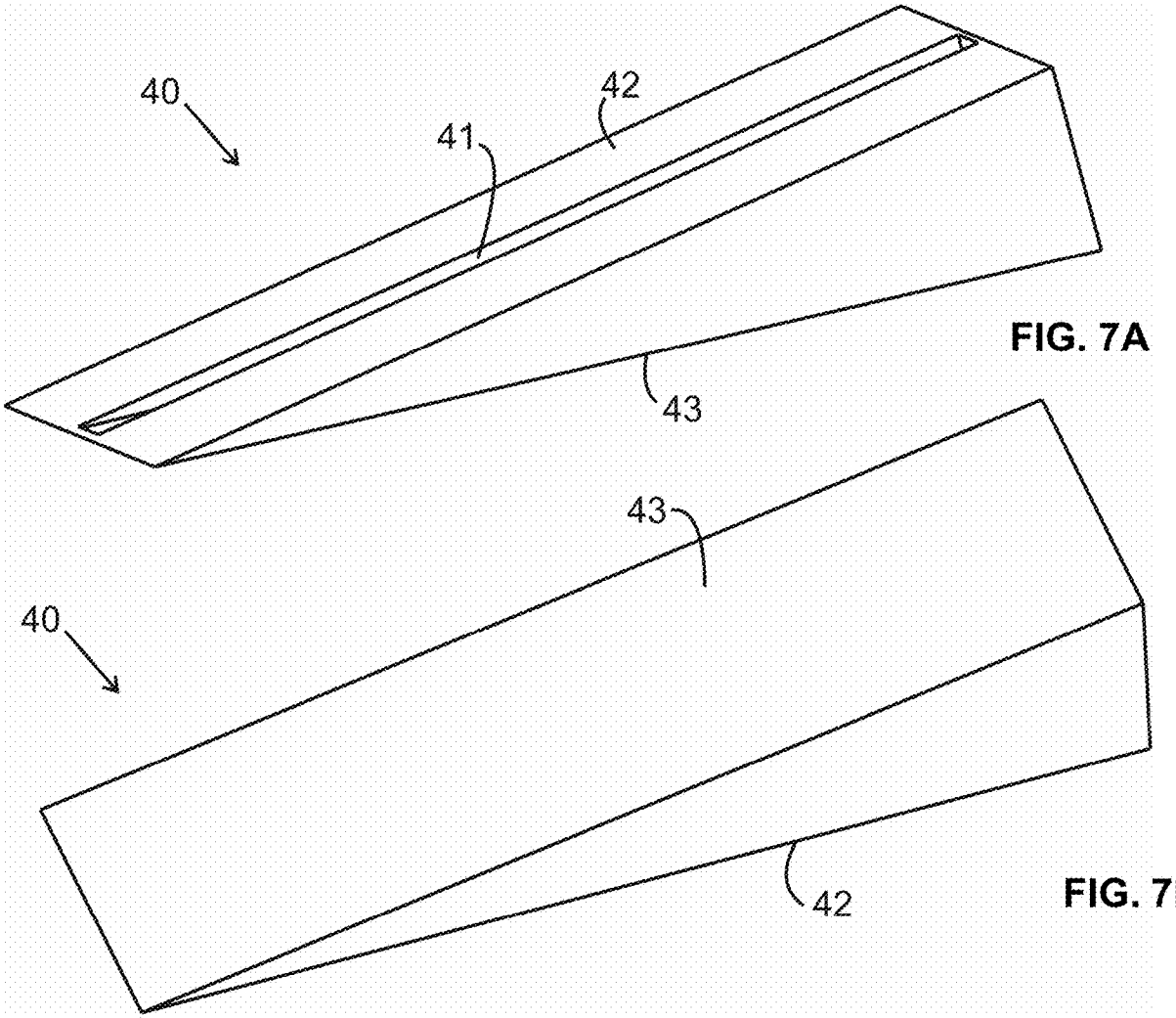
FIG. 7A shows a perspective view of the extension wedge of the present invention from the top.
FIG. 7B shows a perspective view of the extension wedge of the present invention from the bottom.

FIGS. 7A and 7B show the extension wedge 40 in the second embodiment of the present invention. The extension wedge 40 goes inside the wedge 30 to extend the wedge height. The extension wedge 40 is made of a rubber material, which can extend the wedge height for thin tiles. The extension wedge protects the surface of sensitive tiles (marble, glass or mirror tiles) against damage and scratches. Again as shown in FIG. 7A, the extension wedge 40 has at least one slot 41 in its top part 42. The bottom part 43 of the extension wedge 40 is made of a rubber material to prevent scratch to the tiles.

Figure 8:
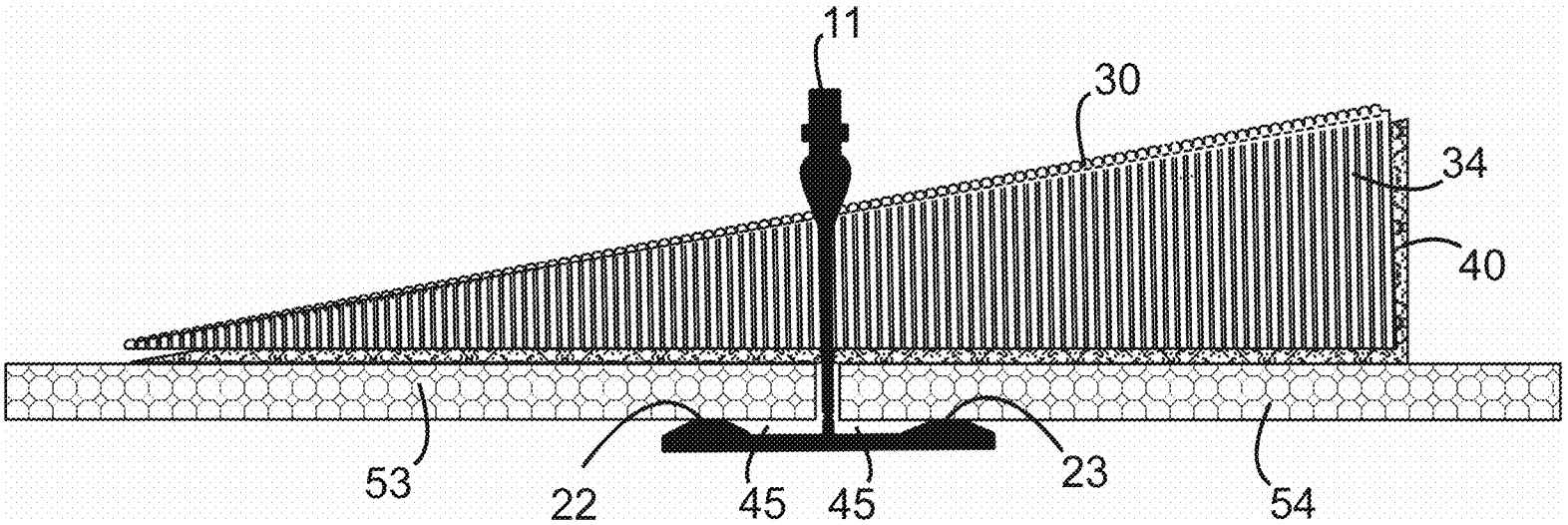
FIG. 8 shows a side view of the second embodiment of the present invention for adjusting and leveling of two tiles.

FIG. 8 shows the second embodiment of the present invention in operation for leveling and adjusting two adjacent tiles 53, 54. The tiles in this case are thinner than the standard tiles, therefore, they require a larger wedge for leveling.

Figure 9:
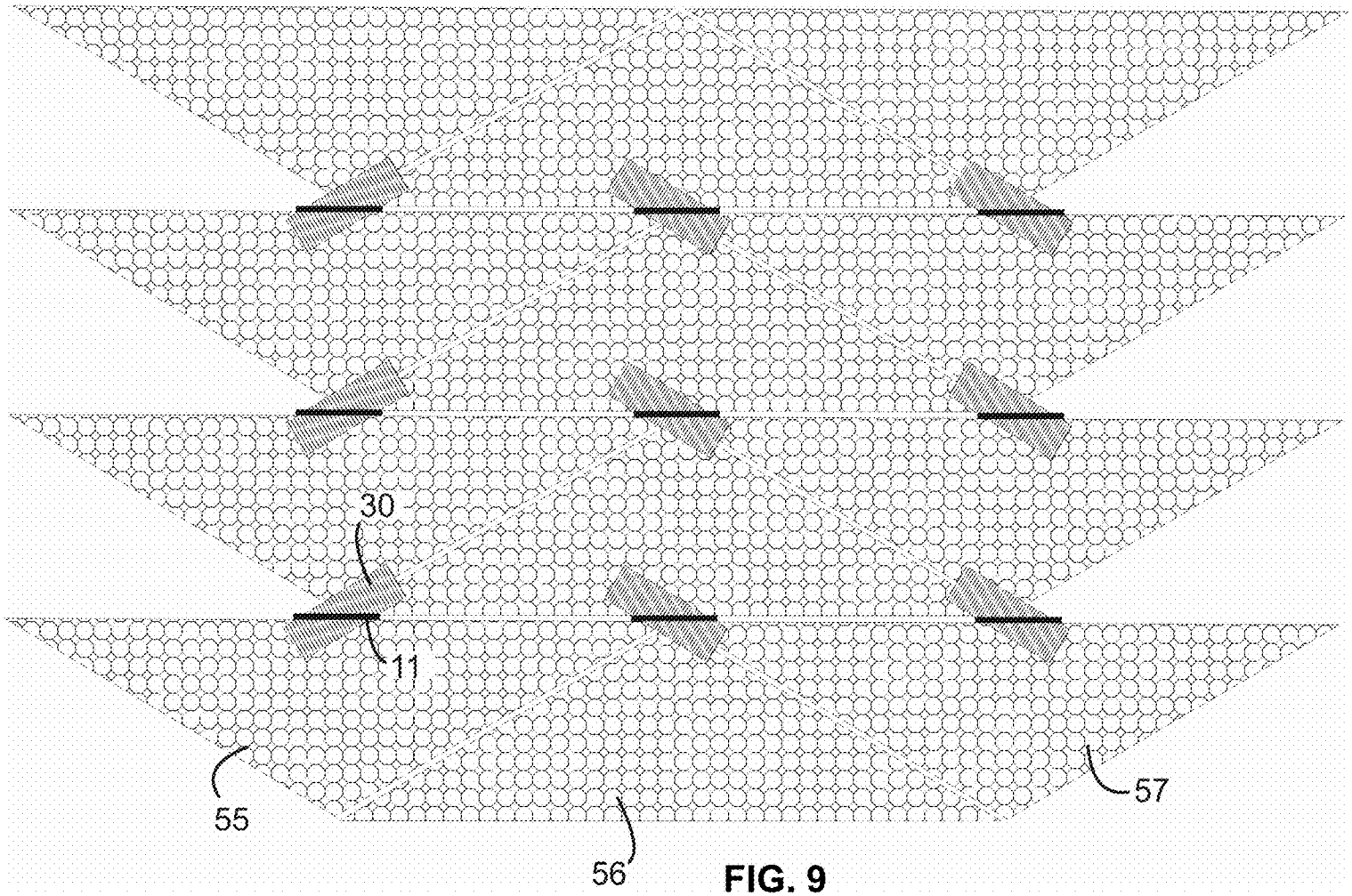
FIG. 9 shows a top view of the first and second embodiments of the present invention for adjusting and leveling of a plurality of triangle tiles.
Figure 10:
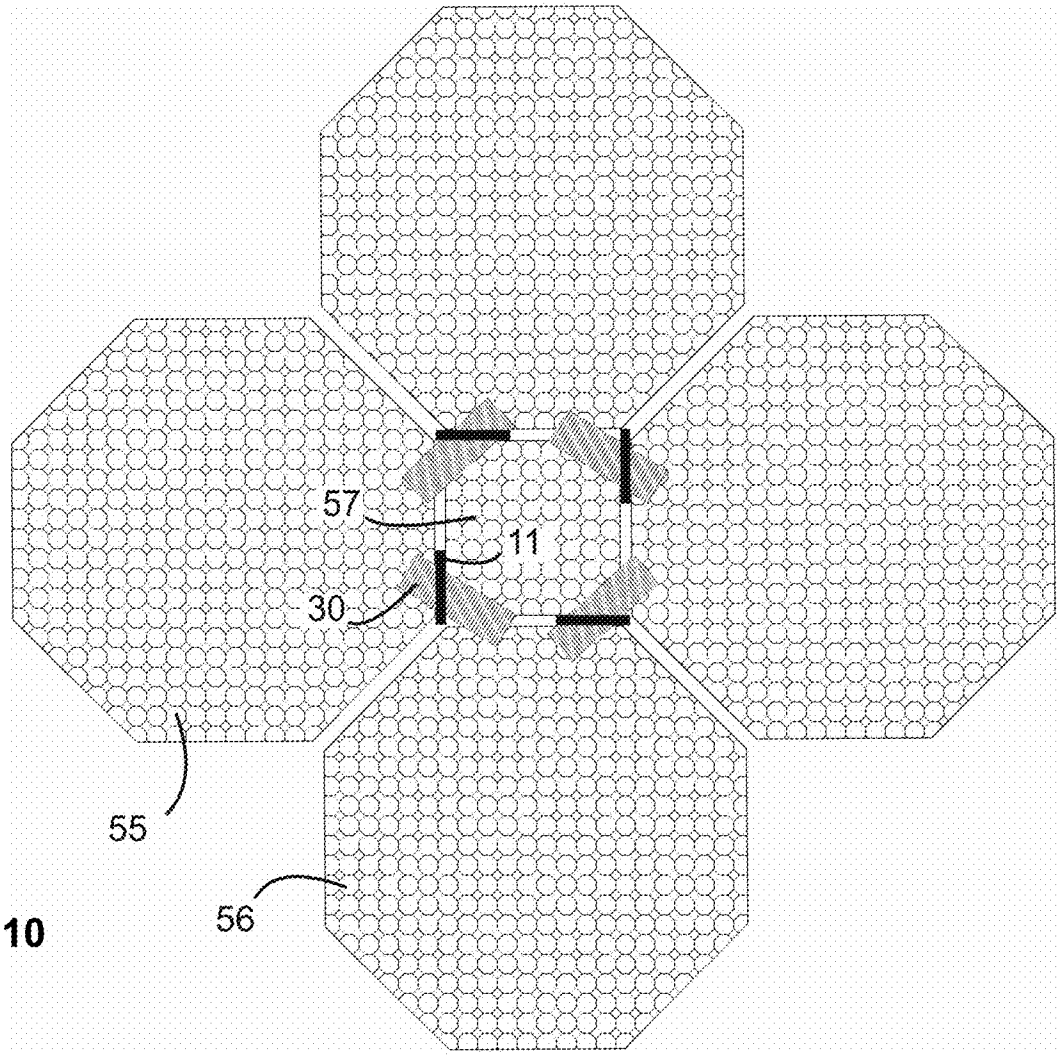
FIG. 10 shows a top view of the first and second embodiments of the present invention for adjusting and leveling of a plurality of hexagonal tiles.

FIGS. 9 and 10 show the present invention in operation for levelling triangular tiles. A clip is set at the triple point joint of three tiles (e.g., 55, 56, 57), and a wedge is inserted into the clip at an angle aligned with one side of one of the triangular tiles. The side wall teeth 34-35 of the present wedge allows the wedge to be diagonally inserted into the clip 11. The diagonal insertion of the wedge 30 inside the clip 11, allows adjusting and levelling of tiles with any shape.

Again as shown in FIGS. 9 and 10, the present wedge can be used on any type of tile patterns, such as criss-cross and triangle tiles. The wedge 30 can be inserted into the clip at a 45 degree angle, while the side teeth 34, 35 grab and hold the wedge 30 in the required position. The side teeth of the present wedge allow it to position itself at any desired angle for different tiles designs. None of the prior art wedges have side teeth, which limits them for only one directional insertion.

Figure 11:
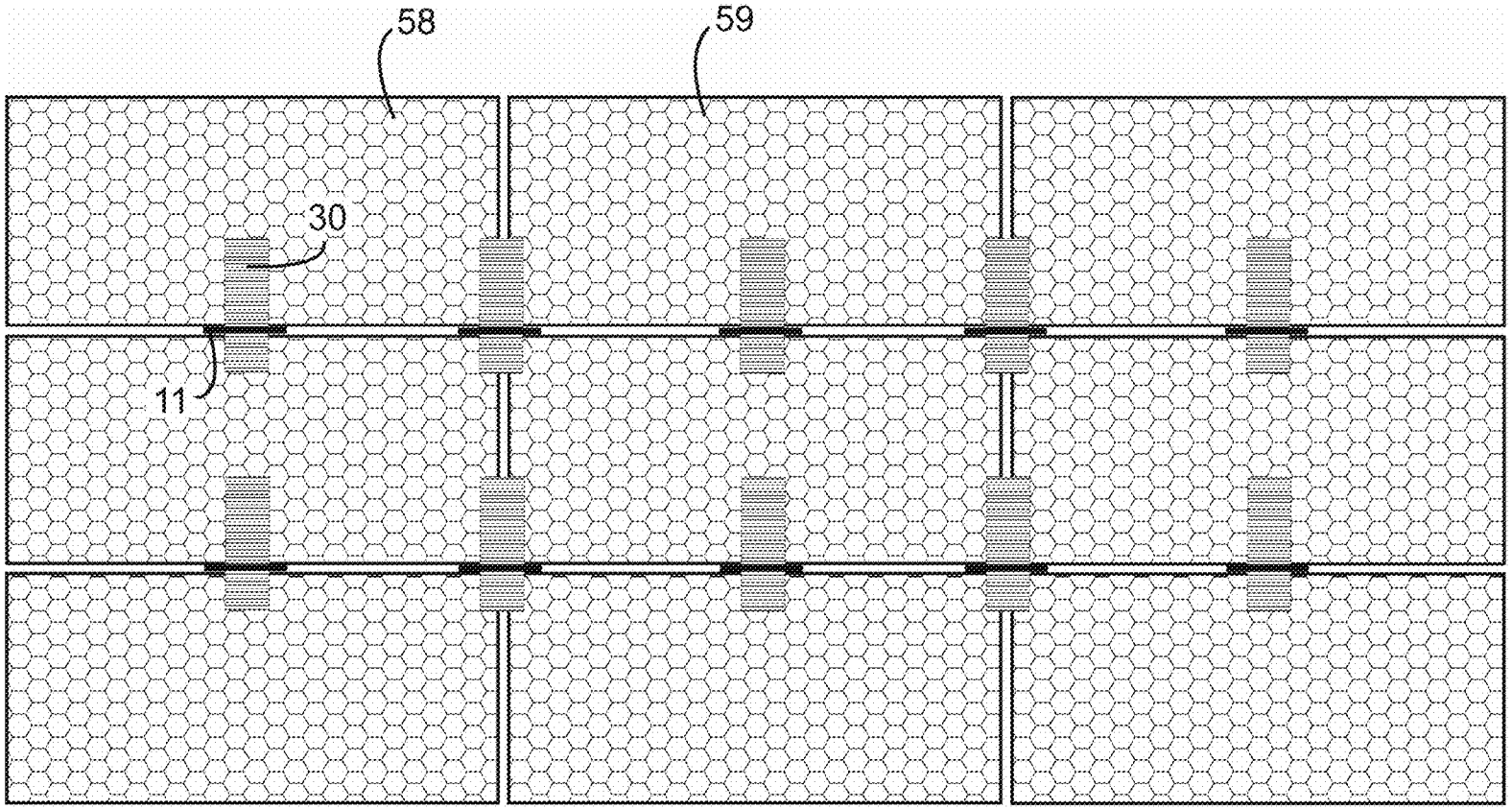
FIG. 11 shows a top view of the first and second embodiments of the present invention for adjusting and leveling of a plurality of regular tiles.

In the movement of the wedge 30 inside the clip 11, the present wedge provides more secure levelling means for the adjusting and levelling of regular tiles 58-59 as shown in FIG. 11. Because three sides 34, 35 and 36 of the first wedge 30 are engaged with three edges 15, 16 and 17 in the opening 14 of the clip 11, the whole structure of the present invention can be securely support the tiles and it prevents the bending which can happens during the contraction and expansion of the mortar.

Figure 12:
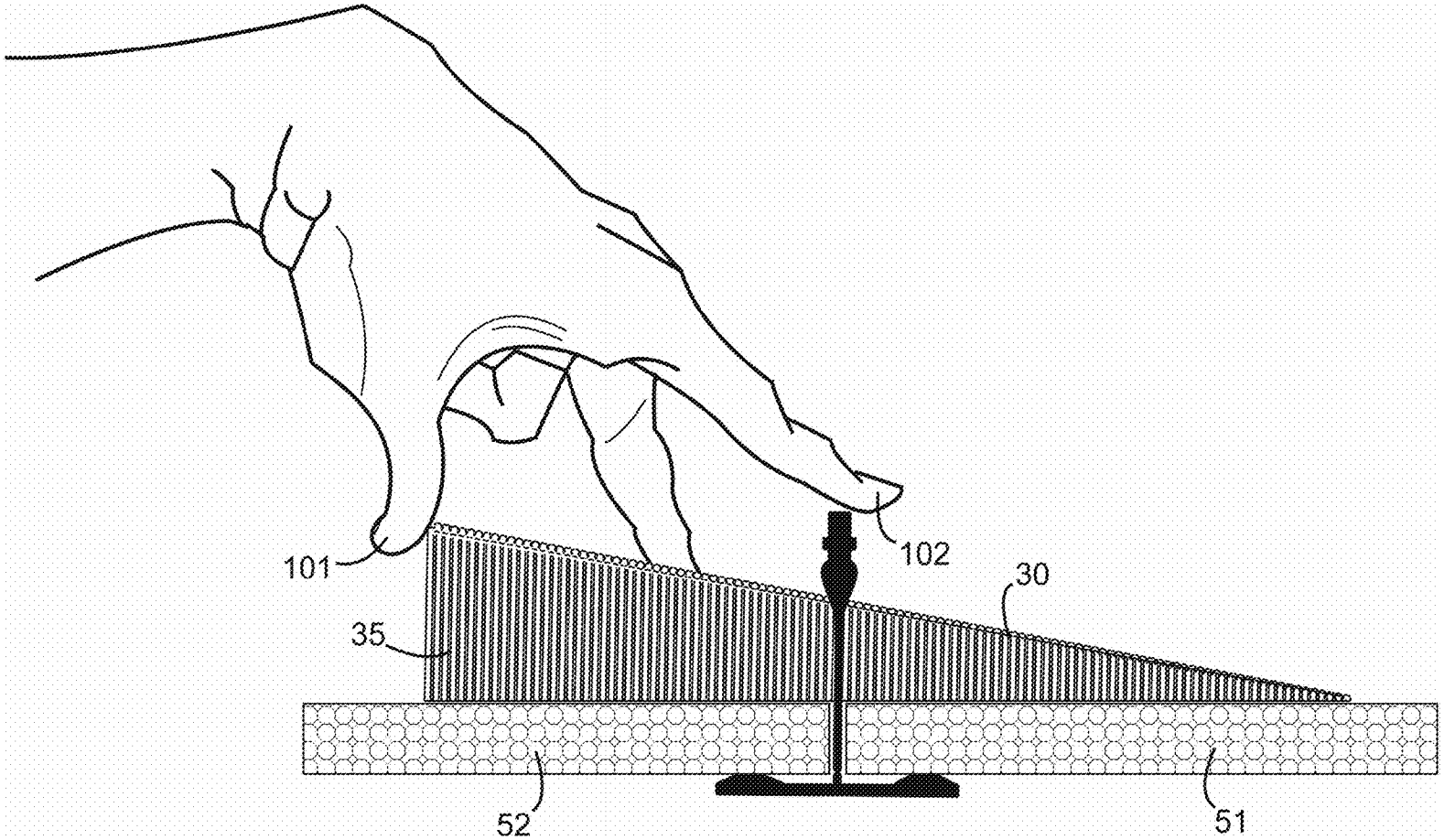
FIG. 12 shows a side view of the first embodiment of the present invention for adjusting and leveling of two tiles.

The specific design of the wedge 30 and the clip 11 in the present invention make it possible to eliminate the need to use a plyer for the levelling and adjusting the tiles during installation. As shown in FIG. 12, the user can use his fingers 101-102 to tighten the wedge 30 inside the clip 11. Being able to only use ones hands rather than plyer enhances the installation process and saves time.

The clip in the present invention can be used to hold and level four regular tiles at their intersection point, as shown in FIG. 11.

Figure 13B:
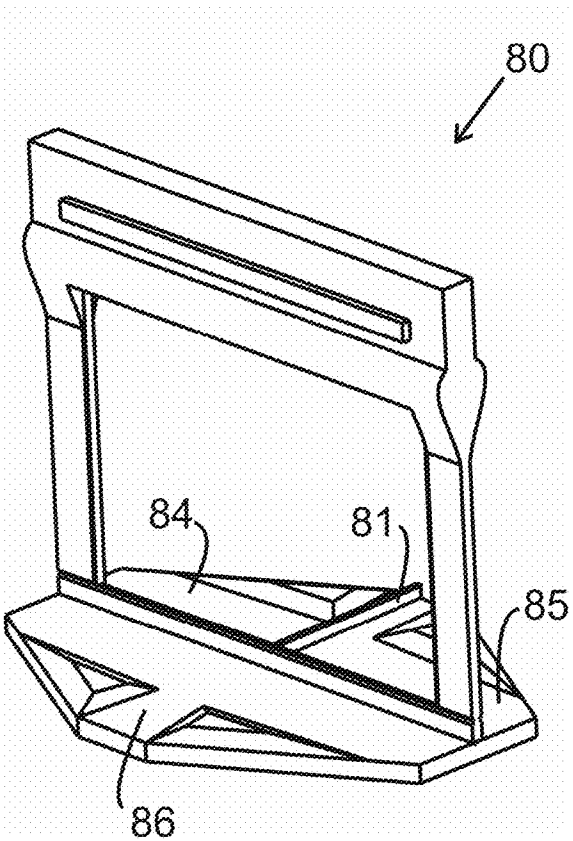
FIG. 13B shows a perspective view of a T-clip of the present invention.
Figure 13A:
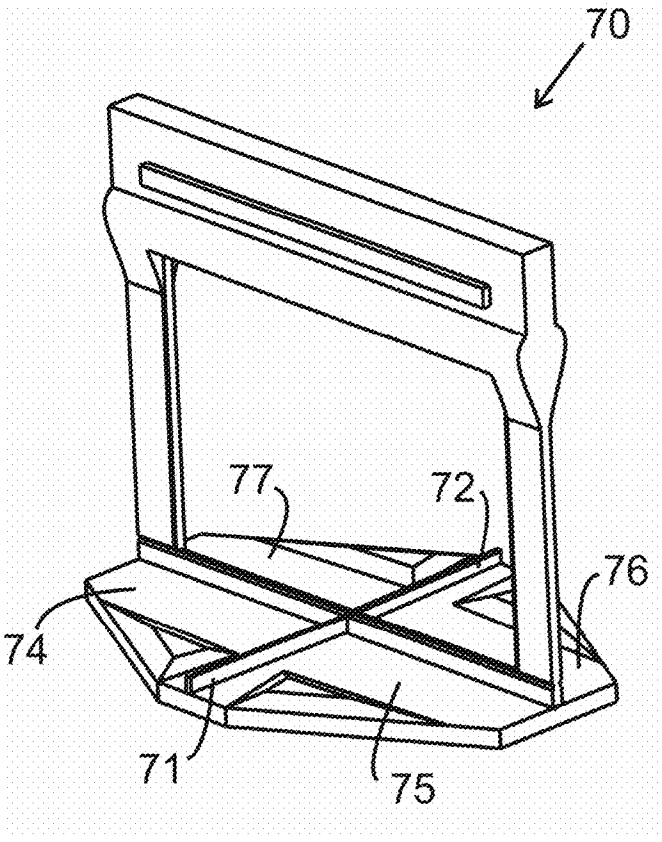
FIG. 13A shows a perspective view of a corner clip of the present invention.

FIG. 13A shows the new design for the corner clip 70 to hold four regular tiles and maintain 90 degree angels between the tiles. A divider wall 71, 72 are designed in each part of the bottom plate 73 to divide it to four equal parts 74-77. Another embodiment for the corner clip 80 is shown in FIG. 13B. The T-clip 80 designed in such a way to grab three adjacent tiles. A divider wall 81 is designed in the bottom plate 83 to divide it to three parts 84-86.

Figure 14:
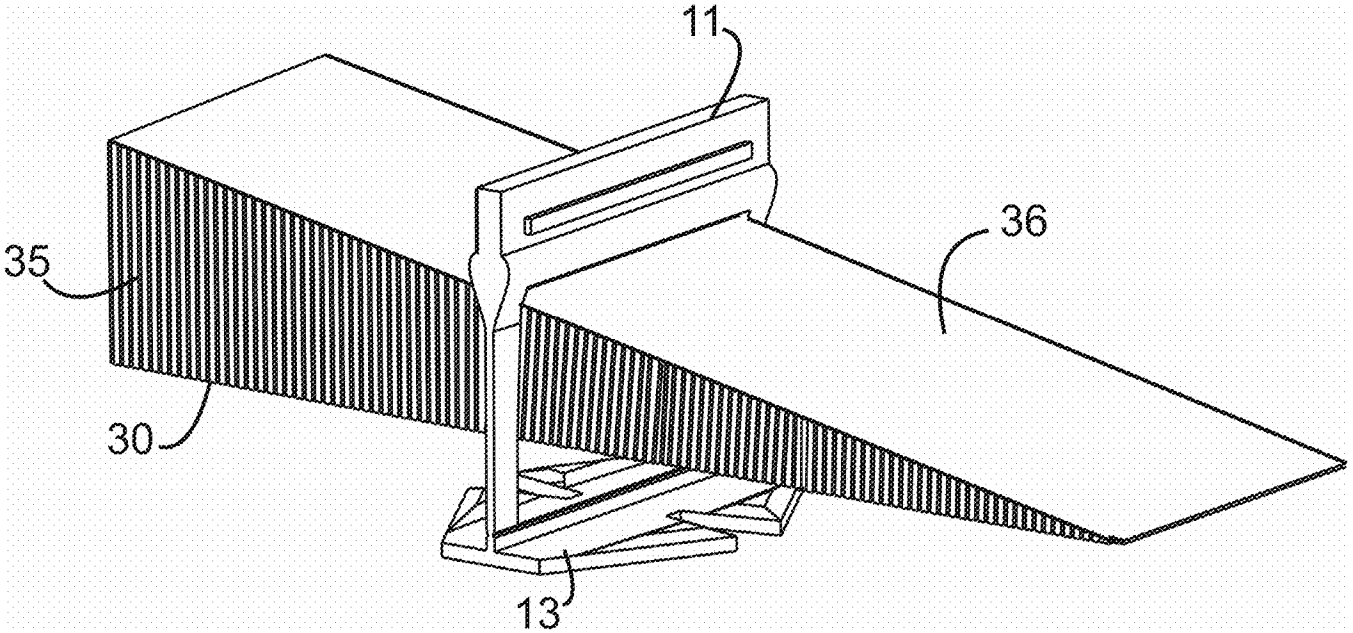
FIG. 14 shows a perspective view of the third embodiment of the present invention.

In a third embodiment of the present invention, the wedge 30 has no teeth on its top side 36 and also the clip 11 has no sharp edge in its top on the opening 14 as shown in FIG. 14.

The present invention simplifies the procedure of installation, while maintaining better quality. These improvements allow the users to speed up the installation and no experience is necessary in order to set a series of tile. The present invention is universal and it can be used for all non-standard shaped tiles.

The present wedge also has a lip to make noise. In the bottom of the wedge, there is a small lip that detects whether the tile are properly set. By moving the wedge back and forward between two tiles, the wedge slides over the lip generating a specific sound. The sound is different for poorly leveled tiles versus that of leveled tiles.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. An adjusting device used for adjusting and leveling a plurality of tiles on a floor or a wall during an installation, said adjusting device comprises:

a) a wedge comprising: a top inclined surface having top-teeth, two side triangular surfaces having side-teeth, and an open back space that is divided into two halves by a wedge-plane;

b) a clip that is placed underneath a laying surface of at least two adjacent tiles, wherein said clip comprises:

i) a bottom plate comprising a flat base; and ii) a top portion perpendicularly extending from the bottom plate and having a clip-opening to receive said wedge, wherein said top portion has three sharp edges around said opening to grab said top-teeth and said side-teeth of said wedge;

whereby said wedge is inserted into said clip-opening and pressed in to level the tiles, and said side-teeth allow for a diagonal insertion of said wedge inside said clip for leveling of an irregular shape tile.

2. The adjusting device of claim 1, further has a ribbon at a distal end of said top portion to strengthen said top portion, said ribbon is designed at both sides of said top portion to resist at maximum pressure during installation for a larger format tile or a stone tile.

3. The adjusting device of claim 1, further has a V-shaped groove at a proximal end of said top portion as a breaking point to facilitate a separation process.

4. The adjusting device of claim 1, wherein said bottom plate further having at least two support protrusions at each side to support a tile.

5. The adjusting device of claim 1, wherein said bottom plate further having two channel-shaped openings to facilitate an over-flow of a mortar between said bottom plate and said tile to provide a strong binding between the bottom plate and the tile.

6. The adjusting device of claim 1, wherein said clip further has a divider in a middle of said flat base to divide said bottom plate to four equal parts.

7. The adjusting device of claim 1, further having an extension wedge sized to fit inside the back space of said wedge to extend a wedge height of the wedge and to protect a top surface of said tile, and wherein said extension wedge has a slot in a top part to be engaged with said wedge-plane.

8. The adjusting device of claim 7, wherein said extension wedge is made of a rubber material.

* * * * *